US009175526B2

(12) United States Patent
O'Blenes

(10) Patent No.: US 9,175,526 B2
(45) Date of Patent: Nov. 3, 2015

(54) TOP DRIVE WITH MOUNTED WINCH

(71) Applicant: TESCO Corporation, Houston, TX (US)

(72) Inventor: Jonathan Brian O'Blenes, Calgary (CA)

(73) Assignee: TESCO CORPORATION, Houston, TX (US)

( * ) Notice: Subject to any disclaimer, the term of this patent is extended or adjusted under 35 U.S.C. 154(b) by 446 days.

(21) Appl. No.: 13/664,231

(22) Filed: Oct. 30, 2012

(65) Prior Publication Data

US 2013/0112430 A1 May 9, 2013

Related U.S. Application Data

(60) Provisional application No. 61/555,849, filed on Nov. 4, 2011.

(51) Int. Cl.
*E21B 19/16* (2006.01)
*E21B 19/00* (2006.01)

(52) U.S. Cl.
CPC ..... *E21B 19/008* (2013.01); *E21B 19/162* (2013.01)

(58) Field of Classification Search
CPC ..... E21B 19/00; E21B 19/008; E21B 19/16
See application file for complete search history.

(56) References Cited

U.S. PATENT DOCUMENTS

| | | | | |
|---|---|---|---|---|
| 6,527,047 | B1 * | 3/2003 | Pietras | 166/77.51 |
| 7,584,810 | B1 | 9/2009 | McKnight, Jr. et al. | |
| 2004/0206551 | A1 | 10/2004 | Carriere et al. | |
| 2005/0167121 | A1 * | 8/2005 | Head | 166/385 |
| 2009/0159271 | A1 * | 6/2009 | De Jong et al. | 166/244.1 |

FOREIGN PATENT DOCUMENTS

| | | |
|---|---|---|
| DE | 4001681 | 12/1990 |
| EP | 2067923 | 6/2009 |
| WO | 2007121510 | 11/2007 |

OTHER PUBLICATIONS

International Search Report and Written Opinion for International Application No. PCT/US2012/062754, mailed Oct. 25, 2013.

* cited by examiner

*Primary Examiner* — Robert E Fuller
*Assistant Examiner* — Steven MacDonald
(74) *Attorney, Agent, or Firm* — Fletcher Yoder, P.C.

(57) ABSTRACT

A system includes a top drive system equipped with a mounted winch configured to draw tubular or well equipment into alignment with a quill of the top drive system. The winch comprises a spool and a flexible line that extends from the spool and through channels in the top drive system, exiting through the quill. An attachment feature at the distal end of the flexible line couples the flexible line with the tubular or drilling equipment. Once this coupling has been established, the winch may rotate such that the flexible line retracts through the quill of the top drive system, drawing the tubular or well equipment into alignment with the quill.

19 Claims, 4 Drawing Sheets

TOP DRIVE WITH MOUNTED WINCH

CROSS REFERENCE TO RELATED APPLICATIONS

This application claims priority from and the benefit of U.S. Provisional Application Ser. No. 61/555,849, entitled "Top Drive With Mounted Winch," filed Nov. 4, 2011.

BACKGROUND

The invention relates generally to the field of drilling and processing of wells, and, more particularly, to a top drive with mounted winch for hoisting drilling equipment.

In conventional oil and gas operations, a well is typically drilled to a desired depth with a drill string, which includes drillpipe, drill collars and a bottom hole drilling assembly. The drill string may be turned by a rotary table and kelly assembly or by a top drive. A top drive typically includes a quill, which is a short length of pipe that couples with the upper end of the drill string, and one or more motors configured to turn the quill. The top drive is typically suspended from a traveling block above the rig floor so that it may be raised and lowered throughout drilling operations.

In conventional operations, to add a length of tubular (i.e., drillpipe or drill collar) to the drill string, a drillpipe elevator is coupled with the tubular to facilitate hoisting the tubular from the rig floor and into engagement with a top drive, which is used to couple the tubular to the drill string. To facilitate coupling of the tubular with the top drive, the tubular is aligned with the quill of the top drive and, consequently, with the center of the well. Drillpipe elevators are configured to couple with drillpipe by engaging a shoulder of a tool joint of the drillpipe. However, drillpipe elevators are generally not configured to couple with drill collars because drill collars do not include tool joints. Therefore, pickup subs are typically connected to one end of a drill collar to facilitate coupling between a drillpipe elevator and the drill collar. After a new length of drill collar is hoisted to the center of the well by the drillpipe elevator and added to the drill string, the pickup sub is removed from the drill collar and connected to the next length of drill collar to be hoisted by the drillpipe elevator.

In addition to tubular, it may be desirable to hoist other drilling equipment (e.g., top drive servicing equipment) toward the top drive quill throughout drilling operations. This equipment may not be configured to couple with a drillpipe elevator directly and, therefore, may require specific connectors to facilitate coupling with the drillpipe elevator. In conventional operations, drilling equipment and tubular may be hoisted with wire cables on pulleys positioned about the drilling rig, and in certain instances multiple pulleys may be used in order to bring a single piece of equipment or tubular into alignment with the quill of the top drive.

The process of coupling and removing connectors in order to add each new length of tubular to the drill string or to position equipment in alignment with the top drive is often time consuming and tedious. In addition, the use of wire cables on pulleys positioned about the oil rig to hoist drilling equipment can lead to cable entanglements. Accordingly, it is now recognized that these hoisting techniques are inefficient and there exists a need for a system and method for hoisting drilling equipment into alignment with the quill of the top drive without the use of connectors or multiple pulley arrangements.

BRIEF DESCRIPTION

Present embodiments are designed to respond to such a need. In accordance with one aspect of the invention, a top drive system comprises a housing, a quill configured to couple with a tubular or well equipment, a motor disposed within the housing that rotates the quill, and a winch coupled with the housing. The winch comprises a motorized spool and a flexible line, which extends through a channel in the quill and includes an attachment feature at its distal end configured to couple with the tubular. As the winch winds the flexible line about the spool, the extended portion of the flexible line shortens, pulling the tubular toward the quill.

Present embodiments also provide a method for bringing well equipment into alignment with the top drive quill. In an exemplary embodiment, the method comprises coupling a tubular and a flexible line that extends from a winch on a top drive, drawing the tubular toward the top drive by winding the flexible line onto the winch, pulling the flexible line through a channel of a quill of the top drive, and aligning the tubular with a coupling feature of the quill as the flexible line is drawn into the channel.

In accordance with another aspect of the invention, a top drive system comprises a quill configured to couple with a tubular, a motor to rotate the quill, a winch with a flexible line and a spool, and an attachment feature at the distal end of the flexible line configured to couple with a tubular. The flexible line may be retracted onto the spool, drawing the line through a channel in the quill and bringing the tubular, which is coupled to the attachment feature, into alignment with the quill for coupling with the quill.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present disclosure provides a novel top drive system and method that can be used in drilling operations. The presently disclosed techniques allow for tubular or drilling equipment to be brought to well center using a top drive with a mounted winch. The winch supplies a flexible line that extends through the quill of the top drive on which the winch is mounted. The flexible line is coupled to an attachment feature configured to couple with various types of tubular (e.g., drill collar) or drilling equipment (e.g., top drive servicing equipment). Winding the flexible line about the winch hoists the tubular or equipment into alignment with the top drive quill and, consequently, the center of the well.

Figure 1:
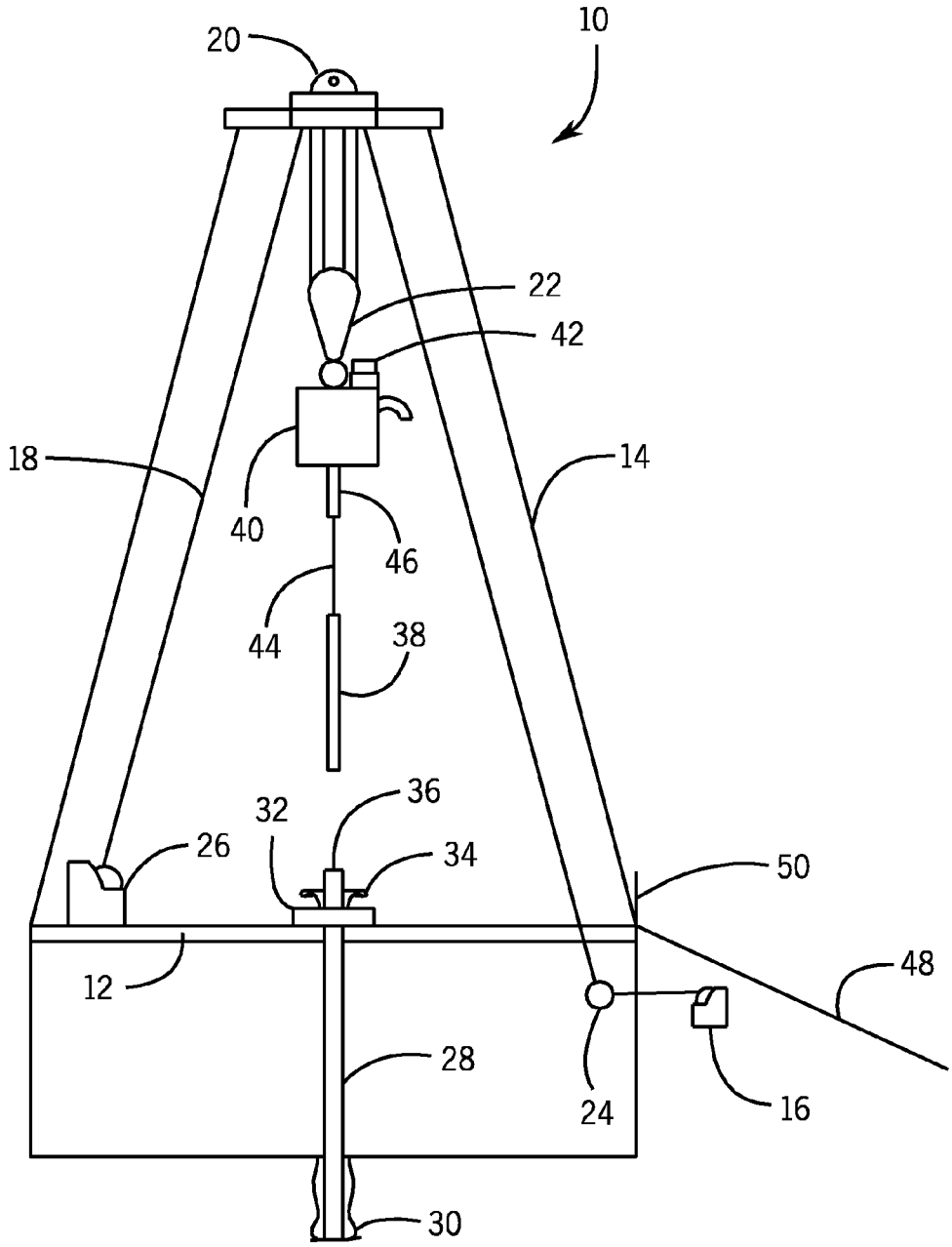
FIG. 1 is a schematic of a well being drilled in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. A top drive 40, hoisted by the traveling block 22, positions the tubular 38 above the wellbore before coupling with the tubular 38. The top drive 40, once coupled with the tubular, may then lower the coupled tubular 38 toward the stump 36 and rotate the tubular 38 such that it connects with the stump 36 and becomes part of the drill string 28.

FIG. 1 illustrates the top drive 40 with a mounted winch 42 and flexible line 44 extending from the winch 42 hoisting the tubular 38 into alignment with a quill of the top drive 40 in accordance with present embodiments. The flexible line 44, which may include wire cable similar to that used for drilling line 18, is wound onto the winch 42 and extends through the quill 46 of the top drive 40. The winch 42, driven by a motor (not shown) that is controlled from the level of the rig floor 12, reels in the flexible line 44 to hoist a new length of the tubular 38 into alignment with well center. When the tubular 38 is aligned with well center, it is also aligned with the center of the quill 46, the stump 36, the drill string 28, and the wellbore 30. Before the tubular 38 is hoisted by the flexible line 44 into alignment with well center, as shown in FIG. 1, the tubular 38 may be transported up a pipe ramp 48 and through a V-door 50 to a position on the rig floor 12 that makes the tubular 38 readily accessible for coupling with the flexible line 44. From the rig floor 10, the tubular 38 may be hoisted by the top drive system in accordance with present techniques.

It should be noted that the illustration of FIG. 1 is intentionally simplified to focus on the top drive 40 with the mounted winch 42 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Furthermore, the utility of present embodiments is not limited to hoisting tubular 38, which is the function illustrated in FIG. 1. As will be appreciated by those skilled in the art, other drilling equipment may require hoisting either toward the top drive 40 or into alignment with well center, and the present embodiments allow for such functions. For example, the winch 42 on the top drive 40 may be used to hoist top drive servicing equipment into alignment with and close proximity to the top drive 40 in order to perform routine maintenance, eliminating the need to coordinate multiple pulleys and wire ropes.

Figure 2:
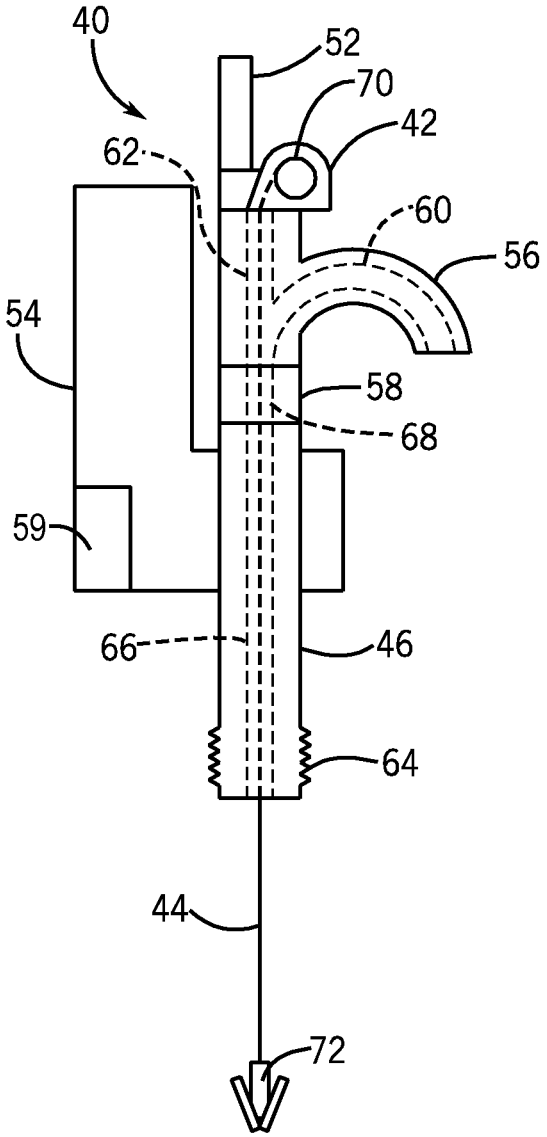
FIG. 2 is a schematic cross-sectional view of a top drive in accordance with present techniques.

FIG. 2 is a detailed illustration of the top drive 40 of FIG. 1 in accordance with present techniques. The top drive 40 comprises a becket 52, a housing 54, the winch 42, a gooseneck 56, a wash pipe 58, and the quill 46. The becket 52 is configured to hang from a hook at the bottom of the traveling block 22, connecting the top drive 40 to the traveling block 22, as shown in FIG. 1. In other embodiments, different coupling features may be included. The housing 54 holds components of the top drive 40, including a motor 59 (or a plurality of motors 59) that rotates the quill 46. The housing 54 is not limited to one structural component configured to house all the components of the top drive 40, but may comprise a plurality of structural components that support individual top drive components (e.g., a housing for the winch coupled to a housing for the top drive motor assembly) or a single structural component that houses only certain components of the top drive 40 (e.g., a housing that supports the quill 46 and the wash pipe 58 but not the gooseneck 56). Accordingly, the housing 54 refers generally to the structural component or components supporting the top drive 40.

The gooseneck 56 of the top drive 40 is fixed or stationary with respect to the top drive housing 54 and features a curved neck portion with a first channel 60 for conveying drilling fluid from a pressurized hose to the top drive 40 during drilling operations. A vertically aligned linear body portion of the gooseneck 56 includes a second channel 62 that joins the first channel 60 within the gooseneck and aligns with the quill 46. The quill 46 features threads 64 configured to couple the quill 46 with tubular 38 so that the top drive 40 may turn the drill string 28 while advancing the drill string 28 down the wellbore 30. In other embodiments, different coupling features may be employed. In addition to threads 64, the quill 46 features a channel 66 through which drilling fluid may flow into the drill string 28. The wash pipe 58 features a channel 68 and connects the stationary gooseneck 56 to the quill 46, acting as a conduit for drilling fluid between the rotating and non-rotating components of the top drive 40.

In addition to the above mentioned components of the top drive 40, the winch 42 is mounted to the top drive housing 54 in accordance with present embodiments. The winch 42 includes a spool 70 and the flexible line 44 disposed about and extending from the spool 70. The flexible line 44 may be wound onto or released from the spool 70 as a motor coupled or integral with the winch 42 turns the spool 70. The flexible line enters the second channel 62 of the gooseneck 56 and extends through the wash pipe channel 68 and the quill channel 66, exiting the top drive 40 through the bottom of the quill 46. At the distal end of the flexible line 44 is an attachment feature 72 configured to engage with drilling equipment (e.g., the tubular 38 shown in FIG. 1). When a connection is established between the attachment feature 72 and drilling equipment, the drilling equipment may be drawn into alignment with the quill 46 and into close proximity to the top drive 40 as the winch 42 retracts the flexible line 44.

It is important to note that top drives vary widely in design, size, application, and compatibility with certain drilling equipment, as will be appreciated by those skilled in the art. For example, a top drive designed for use on a small, truck-mounted drilling rig may be unable to support the same loads of a top drive designed for use on an offshore drilling rig. Despite such differences in size and design, top drives typically include the gooseneck 56, the wash pipe 58, and the threaded quill 46, and these features are generally arranged such that the second channel 62 of the gooseneck 56 aligns with the wash pipe channel 68 and the quill channel 66. These connected channels not only allow drilling fluid to travel through the top drive 40, but provide a channel for the flexible line 44 to extend through the top drive 40. Therefore, in accordance with present embodiments, the exemplary top drive 40 described herein may be achieved by retrofitting a range of top drive designs currently in use on drilling rigs.

Figure 3:
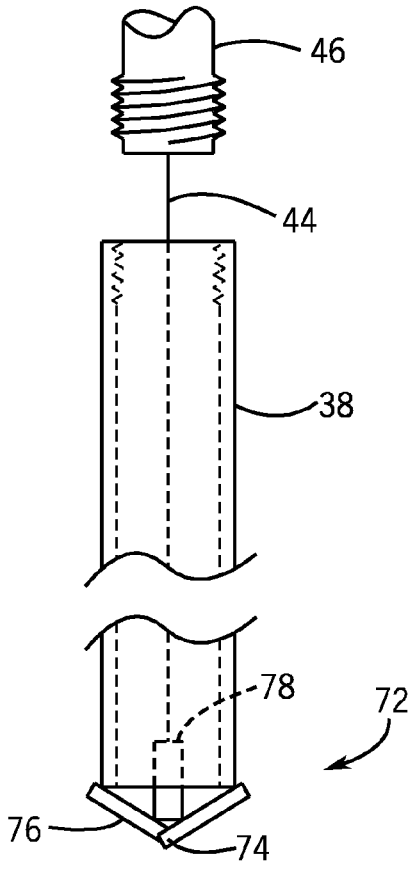
FIG. 3 is a perspective view of an embodiment of an attachment feature in accordance with present techniques.

FIG. 3 illustrates an exemplary embodiment of the attachment feature 72 of FIG. 2 engaged with the tubular 38. This embodiment comprises a grapple head 74 configured to engage with an end of the tubular 38. The flexible line 44 extends through the quill 46 of the top drive 40 and through the length of the tubular 38, supporting the weight of the tubular 38 with the grapple head 74 as the flexible line 44 is retracted by the winch 42. The grapple head 74 comprises a plurality of prongs 76 configured to extend radially outward and abut the bottom edge of the tubular 38. In other embodiments, the grapple head 74 may include different coupling features (e.g., an inflatable wedge). Before reaching the fully extended configuration of the grapple head 74 illustrated in FIG. 3, the grapple head 74 may initially be threaded through the length of the tubular 38 with the prongs 76 collapsed. The prongs 76 may be biased open such that when the grapple head 74 exits the tubular 38, the prongs 76 expand. In other embodiments, the expansion and contraction of the prongs 76 may be controlled by an operator via a control device.

In addition to the prongs 76, the grapple head 74 comprises an auto release latch 78 configured to extend the prongs 76 when the tension on the flexible line 44 exceeds a threshold. This tension threshold may be set such that the prongs 76 remain extended and hooked under the tubular 38 as the weight of the tubular 38 contributes a corresponding tension to the flexible line 44. The threshold may be significantly lower than the force contributed by the mass of the tubular 38 or well equipment acted on by gravity. The auto release latch 78 is also configured to collapse the prongs 76 of the grapple head 74 when the tension on the flexible line 44 drops below the tension threshold. Many scenarios may cause the release in tension that leads to the auto release latch 78 collapsing the prongs 76. For example, the tubular 38 may be pulled into engagement with the quill 46 of the top drive 40, and once the connection is made via the threads 58 on the quill 46, the winch 42 may unwind the flexible line 44. Due to the coupling between the quill 46 and the tubular 38, the slacked flexible line 44 no longer supports the weight of the tubular 38 and the tension drops below the threshold. The auto release latch 78 enables the attachment feature 72 to engage or disengage with the tubular 38 without the addition or removal of special connecting pieces (e.g., the pickup sub mentioned previously), increasing the efficiency of the drilling process.

Figure 4:
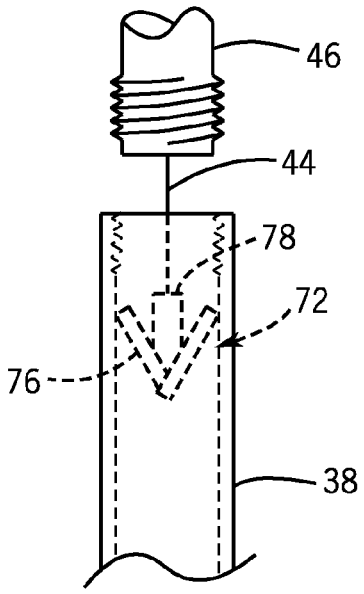
FIG. 4 is a perspective view of another embodiment of an attachment feature in accordance with present techniques.

A second embodiment of the attachment feature 72 is illustrated in FIG. 4. Instead of engaging with one end of the tubular 38, the attachment feature 72 engages with the inside diameter of the tubular 38 through the plurality of prongs 76 expanding radially from the attachment feature 72. A frictional engagement with the wall of the tubular 38 or engagement with threads of the tubular 38 may be achieved in this manner. As previously described, the auto release latch 78 actuates the expansion of the prongs 76 when the tension applied to the flexible line 44 exceeds a known threshold tension value and collapses the prongs 76 when the tension drops below this threshold. In some embodiments, the expansion or contraction of the prongs 76 may be performed based on manual activation of a control device. When expanded, the prongs 76 wedge against the inside diameter of the tubular 38, creating a frictional force that holds the weight of the tubular 38 as it is hoisted into alignment with well center. Since the prongs 76 engage with the inside of the tubular 38 instead of the bottom end of the tubular 38, a connection between the stump 36 and the tubular 38 may be made without removing the attachment feature 72.

Other embodiments of the attachment feature 72 illustrated in FIGS. 3-4 may be envisioned for coupling various types of drilling equipment to the flexible line 44 in order to draw the equipment into alignment with the quill 46 of the top drive 40. These various types of drilling equipment are not limited to lengths of tubular (e.g., drill collar, drillpipe, casing) that are easily supported by the illustrated attachment feature 72. Indeed, other embodiments of the attachment feature 72 may facilitate coupling with top drive servicing equipment and the like. Top drive servicing equipment and other drilling equipment may not include a structural feature compatible with the attachment feature 72, as illustrated in FIGS. 3 and 4. Accordingly, in accordance with present techniques, additional embodiments of the attachment feature 72 may be provided that are configured to couple with drilling equipment not shown in the figures.

Figure 5:
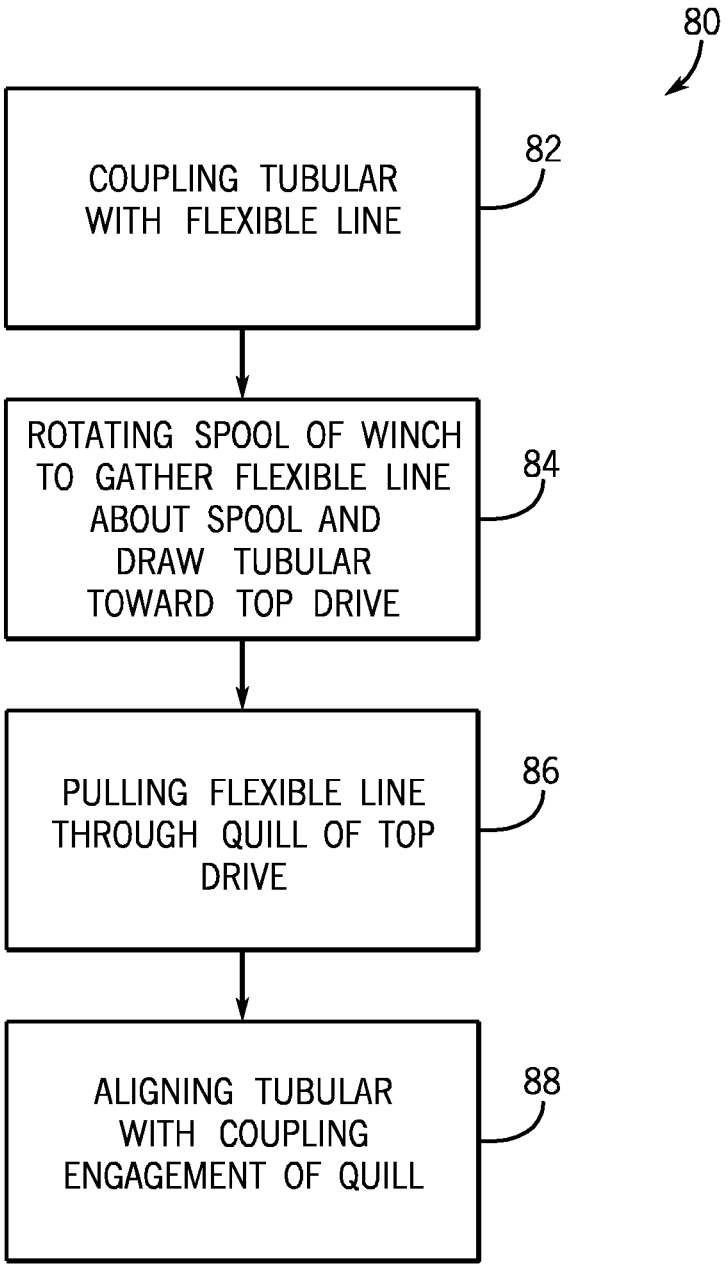
FIG. 5 is a process flow diagram of a method in accordance with present techniques

FIG. 5 illustrates a method 80 in accordance with embodiments of the present disclosure. The method 80 includes coupling a tubular with a flexible line, which extends from a winch mounted on a top drive system, as represented by block 82. The tubular is coupled to the flexible line with an attachment feature, which can engage with an inside diameter of the tubular or with an outer edge of the tubular. Further, the method includes rotating a spool of a winch that is mounted on a top drive system to gather the flexible line about the winch spool in order to draw the coupled tubular toward the top drive system, as represented by block 84. Further, as represented by block 86, the method includes pulling the flexible line through a channel of a quill of the top drive system as the flexible line is gathered about the mounted winch of the top drive system. Still further, the method includes aligning the tubular with a coupling engagement, which may be a threaded section, of the quill, as represented by block 88. As the flexible line is drawn into the channel of the quill, aligning with the quill, the tubular that is coupled to the flexible line also aligns with the quill and is drawn toward the coupling engagement. This allows for the tubular to be brought into engagement with the quill of the top drive system without the addition and removal of special connectors.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A top drive system, comprising:

a housing;

a motor at least partially disposed within the housing;

a quill coupled with the motor and configured to be rotated by the motor about an axis of the quill;

a channel through the quill;

a coupling feature proximate a distal end of the quill configured to facilitate coupling the quill with tubular or equipment;

a winch coupled with the housing, the winch comprising flexible line and a spool, wherein the winch is configured to rotate the spool in a first direction to wind the flexible line about the spool and rotate the spool in a second direction to release the flexible line from the spool; and an attachment feature of the flexible line coupled to a distal end of the flexible line, wherein the attachment feature comprises a plurality of prongs configured to expand radially outward from the attachment feature to couple the attachment feature to the tubular or equipment.

2. The top drive system of claim 1, wherein the flexible line extends from the spool and through the channel of the quill.

3. The top drive system of claim 1, comprising a gooseneck including a first channel through a curved neck portion of the gooseneck and a second channel through a linear body portion of the gooseneck, wherein the first channel joins the second channel within the gooseneck and the second channel aligns with the channel through the quill.

4. The top drive system of claim 3, wherein the flexible line extends through the second channel and the channel through the quill.

5. The top drive system of claim 3, wherein the gooseneck is coupled with the quill via a wash pipe, which includes a channel through the wash pipe.

6. The top drive system of claim 1, wherein the housing comprises multiple separate housings of system components.

7. The top drive system of claim 1, wherein the plurality of prongs is configured to expand to engage an inside diameter of a pipe or tubular component of a piece of equipment.

8. The top drive system of claim 1, wherein the attachment feature is configured to pass through a joint of pipe and the plurality of prongs is configured to expand to engage an outer edge of a distal end of the joint of pipe.

9. The top drive system of claim 1, wherein the winch is positioned relative to the quill such that the flexible line aligns the tubular or equipment for engagement with the coupling feature when the winch winds the flexible line about the spool and the flexible line is coupled with the pipe or equipment via the attachment feature.

10. The top drive system of claim 1, comprising a plurality of motors configured to rotate the quill.

11. A method, comprising:

maintaining a coupling between a tubular and a flexible line of a winch of a top drive system;

rotating the winch of the top drive system such that the flexible line of the winch is gathered about a spool of the winch and such that the tubular is drawn towards the top drive system;

pulling the flexible line through a channel of a quill of the top drive system as the flexible line is gathered about the spool; and aligning the tubular for engagement with a coupling feature of the quill as the flexible line is drawn into the channel of the quill.

12. The method of claim 11, wherein maintaining the coupling between the tubular and the flexible line comprises maintaining engagement between the tubular and an attachment feature.

13. The method of claim 12, wherein maintaining the engagement between the tubular and the attachment feature comprises maintaining a frictional engagement or an abutting engagement.

14. The method of claim 11, comprising coupling the tubular with the quill.

15. The method of claim 11, comprising rotating the quill with at least one motor of the top drive system.

16. A top drive system, comprising:

a quill configured to be coupled with tubular proximate a distal end of the quill;

a motor configured to rotate the quill about an axis of the quill;

a winch comprising flexible line and a spool;

an attachment feature coupled with the flexible line and configured to couple with the tubular;

wherein the winch is positioned with respect to the quill such that, when the tubular is coupled with the attachment feature, retraction of the flexible line towards the winch draws the tubular into alignment with the quill for coupling the tubular with the quill.

17. The top drive system of claim 16, comprising a channel through the quill.

18. The top drive system of claim 17, wherein the flexible line extends through the channel of the quill.

19. The top drive system of claim 16, wherein the attachment feature comprises a grapple head.

* * * * *